US008661994B2

(12) United States Patent
Bachmann

(10) Patent No.: US 8,661,994 B2
(45) Date of Patent: Mar. 4, 2014

(54) CLADDING ELEMENT FOR DEVICE SECTIONS OF INCINERATORS

(75) Inventor: Marco Bachmann, Burglen TG (CH)

(73) Assignee: MB Wasserstrahlschneidetechnik AG, Bürglen (CH)

( * ) Notice: Subject to any disclaimer, the term of this patent is extended or adjusted under 35 U.S.C. 154(b) by 206 days.

(21) Appl. No.: 13/081,025

(22) Filed: Apr. 6, 2011

(65) Prior Publication Data

US 2011/0259252 A1 Oct. 27, 2011

(30) Foreign Application Priority Data

Apr. 21, 2010 (CH) ..... 0575/10

(51) Int. Cl.
*F23M 3/12* (2006.01)
*F23M 5/00* (2006.01)

(52) U.S. Cl.
USPC ..... 110/323; 110/336

(58) Field of Classification Search
CPC ..... F23H 3/02; F23H 2900/17002; F27D 1/0033; F23M 3/00; F23M 3/02; F23M 3/04; F23M 3/06; F23M 5/08; F23M 5/085
USPC ..... 110/298, 346, 300, 328, 291, 322, 323, 110/324, 326, 336, 337; 165/134.1, 169, 165/170; 198/778; 126/152 R, 163 R; 29/890.03, 890.039, 890.054, 726
See application file for complete search history.

(56) References Cited

U.S. PATENT DOCUMENTS

| | | | | |
|---|---|---|---|---|
| 2,745,364 | A * | 5/1956 | Johannes | 110/298 |
| 4,275,706 | A * | 6/1981 | Pauli | 126/163 R |
| 4,314,541 | A * | 2/1982 | Martin et al. | 126/163 R |
| 4,857,153 | A | 8/1989 | Divisek et al. | |
| 5,673,636 | A * | 10/1997 | Stiefel | 110/346 |
| 5,680,824 | A * | 10/1997 | Kemter et al. | 110/348 |
| 5,724,898 | A * | 3/1998 | von Bockh et al. | 110/291 |
| 5,913,274 | A * | 6/1999 | Kunzli et al. | 110/328 |
| 6,024,031 | A * | 2/2000 | Stiefel | 110/281 |
| 6,269,756 | B1 * | 8/2001 | Sachs et al. | 110/298 |
| 2008/0245517 | A1 * | 10/2008 | Ishikawa et al. | 165/169 |
| 2009/0101320 | A1 * | 4/2009 | Stiefel et al. | 165/134.1 |

FOREIGN PATENT DOCUMENTS

| | | |
|---|---|---|
| DE | 3820448 A1 | 12/1989 |
| EP | 0321711 A1 | 6/1989 |

(Continued)

OTHER PUBLICATIONS

European Search Report for European Patent No. 10191539. Date of completition of search report Jan. 17, 2011.

*Primary Examiner* — Kenneth Rinehart
*Assistant Examiner* — David J Laux
(74) *Attorney, Agent, or Firm* — Fleit Gibbons Gutman Bongini & Bianco PL; Marty Fleit; Paul D. Bianco

(57) ABSTRACT

A cladding element for device sections of incinerators consists of a lower plate (1) made of steel and an upper plate (2) made of steel, which lie one atop the other and are tightly bonded with each other at least in the edge areas. A meandering channel (3) is formed between the lower plate (1) and upper plate (2) for guiding a cooling medium through the cladding element. Either the upper plate (2) or lower plate (1) is here a milled sheet with a meandering milled slot (4), which forms the channel (3), and the side of the upper plate (2) facing away from the lower plate (1) has a weld plating (5).

9 Claims, 6 Drawing Sheets

(56) References Cited

FOREIGN PATENT DOCUMENTS

| | | | |
|---|---|---|---|
| EP | 0621449 | A1 | 10/1994 |
| EP | 1321711 | | 6/2003 |
| GB | 2166120 | A | 4/1986 |
| JP | 7004634 | A | 1/1995 |
| WO | 2007/107024 | A1 | 9/2007 |

* cited by examiner

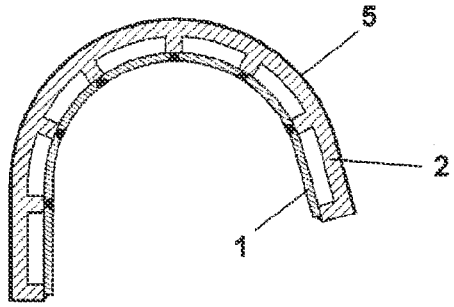
Fig. 5
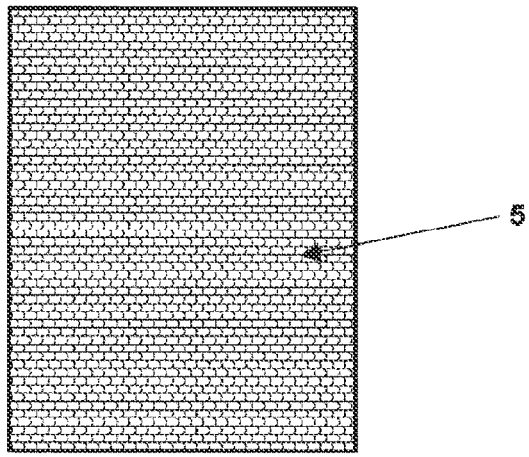
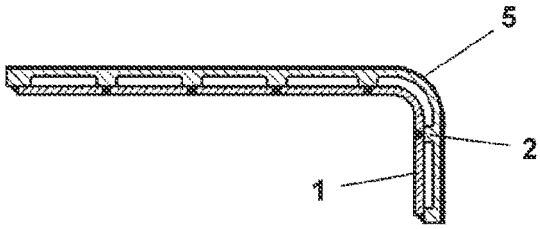
Fig. 6
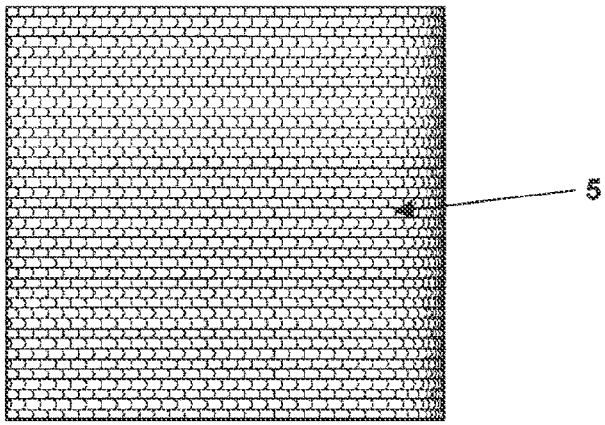

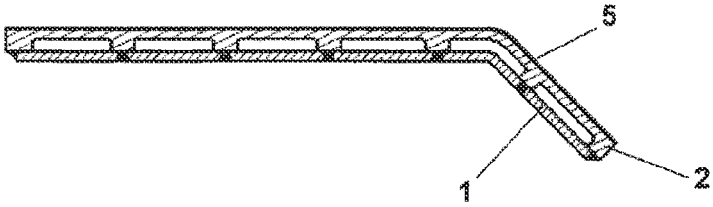
Fig. 7
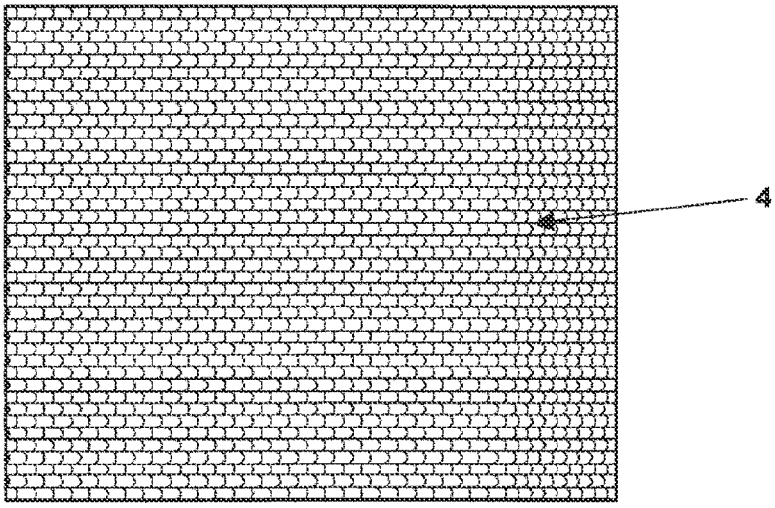
Fig. 8
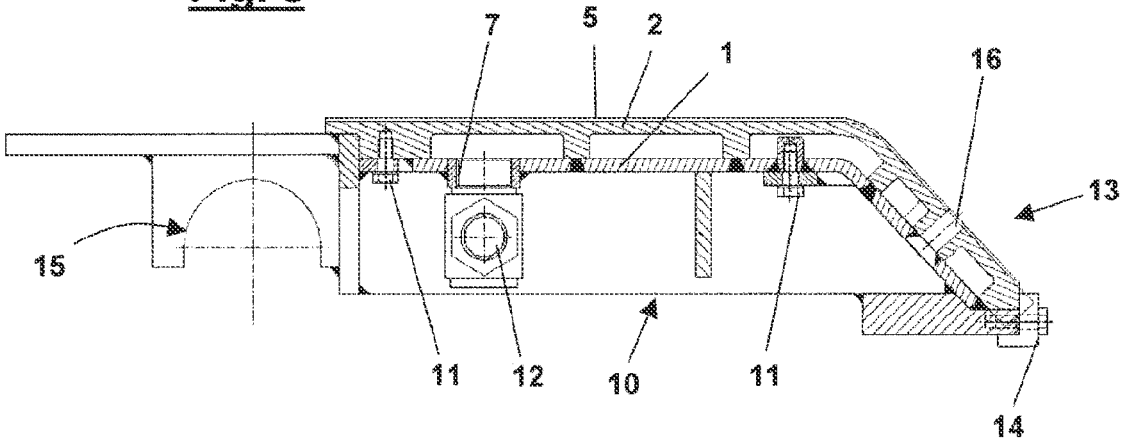

CLADDING ELEMENT FOR DEVICE SECTIONS OF INCINERATORS

CROSS REFERENCE TO RELATED APPLICATIONS

This application claims priority under 35 U.S.C. §119 to Swiss Patent Application No. CH-00575/10 filed Apr. 21, 2010, the entire contents of which are incorporated herein by reference.

FIELD OF THE INVENTION

The invention relates to a cladding element for device sections of incinerators.

BACKGROUND OF THE INVENTION

The invention relates in particular to a cladding element for device sections of incinerators that consists of a lower plate made of steel and an upper plate made of steel, which lie one atop the other and are tightly bonded with each other at least in the edge areas, wherein a meandering channel is formed between the lower plate and upper plate for guiding a cooling medium through the cladding element.

Device sections of incinerators, in particular garbage incinerators, are most often exposed to very high loads. These are thermal, chemical and mechanical loads, and frequently combinations thereof, of course. Since garbage incinerators most often make use of moving grates that mechanically convey incineration material into the combustion chambers, especially strong abrasive loads must here be expected, which are amplified even further as a result of high temperatures softening the metal sections. For this reason, the moving parts that are especially threatened in these moving grates, specifically the grate plates of the individual grate steps, are normally designed as medium-cooled hollow bodies. As a rule, water is used as the cooling medium. Cooling reduces the mechanical wear caused by abrasion, and hence of course ends up lowering the cost of maintenance, since the metal parts exposed to wear need to be replaced less often.

EP-0 621 449 shows a method for burning garbage on an incineration grate, as well as an incineration grate that can be used for this purpose. The individual grate plates of the incineration grate have the outward appearance of a board, which is made of sheet metal, and forms a hollow body with an upper and lower side. This hollow body is comprised either of two half-shells or a hollow profile. It has a connecting branch on the one side of the lower side, and a delivery branch on the other side of the lower side for supplying and discharging a cooling medium that flows through the hollow body. In addition, the grate plate extends in its longitudinal direction over the entire width of the incineration grate. Baffle plates can be welded to the interior of the grate plate in such a way as to yield a labyrinthine, meandering channel for the cooling medium.

To ensure that the grate plates of the incineration grate according to EP-0 621 449 are heat resistant, they are made out of a manganese-alloyed sheet metal that is thick enough so still be bendable, for example, meaning having a thickness measuring around 10 mm. In addition, it is also specified that the sheet metal is to have a sufficiently good thermal conductivity, so that no great temperature differences can arise within the grate, making it possible to avoid stresses in the material.

It has been discovered that the water-cooled grate plates according to EP-0 621 449 commonly used today exhibit several disadvantages. For one, the components are heavy and complex, and their production, installation and replacement is associated with a high outlay. Just the high weight of individual grate plates alone requires complicated preparations during repair operations.

It is further known that manganese sheet and manganese steels reach a very high level of hardness, and hence a very high wear resistance, due to their high manganese content, but these materials are also highly susceptible to a change in material properties (embrittlement) upon reheating. Reheating to beyond specific limits results in failure in the course of welding operations (e.g., when manufacturing or repairing such objects), or in cases involving use in incinerators given overheating during operation. In the event of leaks caused by excessive wear, the complex process of replacing entire components is replaced by cutting only the defective partial piece out of the sheet, and welding in a new partial piece, as a result of which this very welding process again entails a risk that the original wear resistance will not be achieved, and the repaired site will consequently have to undergo subsequent and additional repairs.

Since these inherent disadvantages were of course recognized, an attempt was made to find solutions for more easily replacing the wearing parts. One example of an alternative solution is described in WO/2007/107024. This publication discloses a liquid-cooled grate with wearing plates. The grate consists of a liquid-cooled grate plate and a wearing plate that can be placed thereupon. A layer comprised of a thermally conductive material in the form of a highly thermally conductive soft silicone film is advantageously wedged between the grate plate and wearing plate. The silicone film is sued to create a good thermal transfer between the wearing plates and flow-through grate plates. This is intended to ensure that the wearing plates always remain in an uncritical temperature range during operation, because they are cooled by the underlying cooled grate plates, which are approx. 50° C. With respect to the wearing plate, it is specified that a suitable material was one that was sufficiently hard and mechanically resistant, and could be cooled by the underlying plate so as to remain at a temperature that would not compromise its hardness. For example, Hardox steel is specified as a suitable material. Hardox wearing sheets are steel alloys that also contain manganese, in which the strength properties upon delivery cannot be achieved again after heated above a specific temperature limit, for example about 250° C. The stipulated thickness of such wearing sheets measures about 5 to 10 mm.

As a result, the solution according to WO/2007/107024 was still associated with disadvantages similar to those in EP-0 621 449. While it was easier to replace the wearing plates, since very large and heavy parts no longer had to be removed and installed, the dependence on observing certain temperature limits remains in place, because the original wear resistance can only be maintained in this way. Another disadvantage is that any leaks that might nonetheless arise make it necessary to replace not just the wearing plates, but also the underlying, highly thermally conductive films, since these have no comparable wear resistance.

Another solution is known from EP-1 321 711. It depicts an air-cooled grate rod for a moving grate furnace. While a two-plate structure with an upper plate and lower plate is also involved, there is no meandering channel between these two plates, but rather just a cooling gap. In addition, the grate rod is designed as a cast section. As a result, this case also involves a conventional solution, with the disadvantages of a high weight and undifferentiated cooling air distribution, since the cooling air only flows through the cooling gap in the longitudinal direction of the grate rod.

Finally, DE-38 20 448 discloses a cooled wall element for metallurgical furnaces. For example, the disclosed wall element can consist of a metal plate and metal tube half shells welded thereto, wherein a copper layer with a high thermal conductivity is applied onto the metal plate inside the furnace. This copper layer can be applied through weld cladding. However, the basic element structure does not incorporate two metal plates lying continuously over each other, but rather a plurality of individual metal tube half shells in place of the one plate. Therefore, the component is very difficult to manufacture, and also is not provided with an especially wear resistant, but only a readily thermally conductive, inner coating due to the completely different type of application in metallurgical furnaces.

SUMMARY OF THE INVENTION

Therefore, the object of the invention is to indicate a better solution.

This object is achieved by the features in claim 1.

The solution involves having either the upper plate or lower plate in a generic cladding element be a milled sheet with a meandering milled slot, which forms the channel for guiding a cooling medium, and having the upper plate have a weld plating on the side facing away from the lower plate.

Weld platings have already been proposed with respect to the grate floors of incinerating systems, for example, in JP-7004634. However, this publication involves cast parts, in particular cast parts with a high chromium content, which also are not provided with specific features for the targeted distribution of cooling air or cooling medium streams. In other known medium-cooled grates for incinerating systems (for example, "The Incineration Grate Technology of SFA Handels GmbH for Biomass, Substitute Fuel and Garbage" PDF document dated May 2010), grate plates made of castings with a high chromium percentage are also used. In the case of highly loaded grate plates, it appears to be traditionally assumed that cast parts should preferably be used. However, it has now surprisingly been shown that conventional steel plates provided with a high-quality and wear-resistant weld plating can also yield just as good results in many cases.

One of the main advantages to such a mode of construction is that, as opposed to conventional solutions, components requiring heavy, complex and expensive compositions need no longer be fabricated, instead of which only individual sheets (lower and upper plate) have to be machined, which then are especially easy and logical to assemble. The sheet machining processes required for this purpose only encompass standard methods, such as cutting, drilling and in particular milling, i.e., all procedures that are suitable for largely automated fabrication on machining benches, and thus permit an efficient and cost-effective production. In addition, the basic material for both the lower plate and upper plate can in principle be a conventional steel, which of course is also beneficial in terms of cost.

Because the channel for guiding a cooling medium is designed as a meandering, milled slot in the upper plate or lower plate, its progression and cross section can be flexibly configured to reflect the operating location and conditions, which is greatly facilitated with the numerically controlled machining processes commonly used today. This also results in additional flexibility in production.

However, the main advantage is derived from the introduction of a weld plating on the 'wearing side' of the upper plate. As already mentioned, the wearing side is subjected to very high abrasive, thermal and even chemical loads, in particular in garbage incinerators. Weld plating is a known process, which is also referred to as 'cladding' or build-up welding. A high-alloyed steel is here applied as surface protection on highly loaded, but generally low-alloyed base metals. This application can take place by means of a welding robot, for example. In this case, the base material that is weld plated receives an application layer that as a rule is several mm thick. The high-alloyed steel used for this application layer is of course selected based on the load requirements (hardness, chemical resistance, etc.). Examples of such application or protective layers include Inconel or A-Dur 600. The advantage to such weld platings is that they exhibit far better abrasion resistance than the previously used Hardox sheets given the right selection and in particular if an additional cooling system is present to ensure as low a material softening as possible from exposure to high temperature. However, in particular the emergency operation features are greatly improved. The temperature limits that were previously to be observed can be briefly exceeded without necessarily permanently and irreversibly diminishing the abrasion resistance of the affected material sections. In less critical areas, the cooling system must no longer run continuously, or can even be excluded completely under certain conditions.

Several layers are advantageously applied consecutively during weld plating. This is because the sections of the base material become mixed with the application material due to the high welding temperatures, which of course alters the properties of the application material. The serial application of several layers can ameliorate this effect.

Since cladding elements with the described structure can be rationally and serially produced, it is much easier and simpler to design them as replacement parts that are easy to use. As a result, it is possible to equip the cladding elements according to the invention with connection means that can be used to easily and quickly attach them to a substructure provided for mounting purposes, and again remove them. These connection means can be bolting, plug-in or suspension means. Assuming that replacement parts can only be manually handled without undue complications if the individual cladding elements weigh at most roughly 40-50 kg, it readily becomes clear that this requirement in the envisaged area of application can best be satisfied with an object suitable for rational serial production, since the parts are then most often needed in higher numbers. Of course, this also necessitates that the cooling medium ports satisfy the condition of being easy to attach and remove. However, this can in most instances be effectively realized with screw-in threaded sockets for the cooling line ports.

As a whole, the advantage to the solution according to the invention is that the proposed structural design can be expanded to a plurality of potential embodiments. For example, the layout for an incinerator can provide an entire range of differently shaped cladding elements, wherein the individual embodiments are reasonably of course also tailored to the locally encountered environmental conditions. As readily understandable, for example, the prevailing conditions are different in a feed shaft than in the actual incineration area. Even so, cladding elements according to the invention can also be used here.

The cladding elements can also be integrated or expanded in existing components.

There are various possibilities with respect to manufacturability as well. On the one hand, it can be provided that a cladding element according to the invention first be fabricated as a flat object, and only later be bent into the desired final shape. Of course, this can only be done if the cladding element is not too thick, since the machining forces or machining equipment required for this purpose would otherwise become far too large. The assumption is that a plate thickness of up to 20 mm easily permits this.

On the other hand, of course, it can be provided that the lower plate and upper plate be fabricated as reciprocally matching, bent partial objects, and only joined together later. This makes it possible to manufacture cladding elements with a greater wall thickness. In addition, it can be provided that the milled slot of the plate (lower or upper plate) initially runs continuously at precisely those locations where the subsequent bend will then take place (since it is naturally easier to bend it at the thinner, milled locations). In cases like these, establishing the integrity of the meandering channel at the 'additionally' milled-out locations before the lower plate is assembled with the upper plate naturally requires that corresponding channel wall parts again be welded in. However, such manufacturing processes make it possible to easily fabricate cladding elements according to the invention with an overall wall thickness of up to about 50 mm.

As a whole, the proposed solution makes it possible to make the current structural designs of water-cooled elements less expensive to manufacture, and above all more easy to service. Expensive repairs of corresponding leaks are no longer required, and entire fill shafts must also no longer be replaced at a high outlay, for example. These intricate repair jobs can be avoided with the proposed weld-plated, medium-cooled cladding elements. The integration of cladding elements only still requires a suitable substructure, i.e., in the case of shaft walls, a rib frame, for example, to which cladding elements are tightly bolted. If the applied hard plating of a cladding element becomes damaged by the continuous sliding motion of the garbage, individually damaged cladding elements can be replaced very easily. The substructure, i.e., the rib frame, can be used time and again to accommodate the cladding elements. This makes the entire structural design and incurred service work much less expensive.

BRIEF DESCRIPTION OF THE DRAWINGS

The invention will be explained in greater detail below based on exemplary embodiments. Shown on:

FIG. 5 is another cladding element according to the invention in embodiment F, FIG. 6 is another cladding element according to the invention in embodiment D, FIG. 7 is another cladding element according to the invention in embodiment K and G, FIG. 8 is a cladding element according to the invention in embodiment K for a moving grate on a substructure.

DETAILED DESCRIPTION OF THE INVENTION

Figure 1:
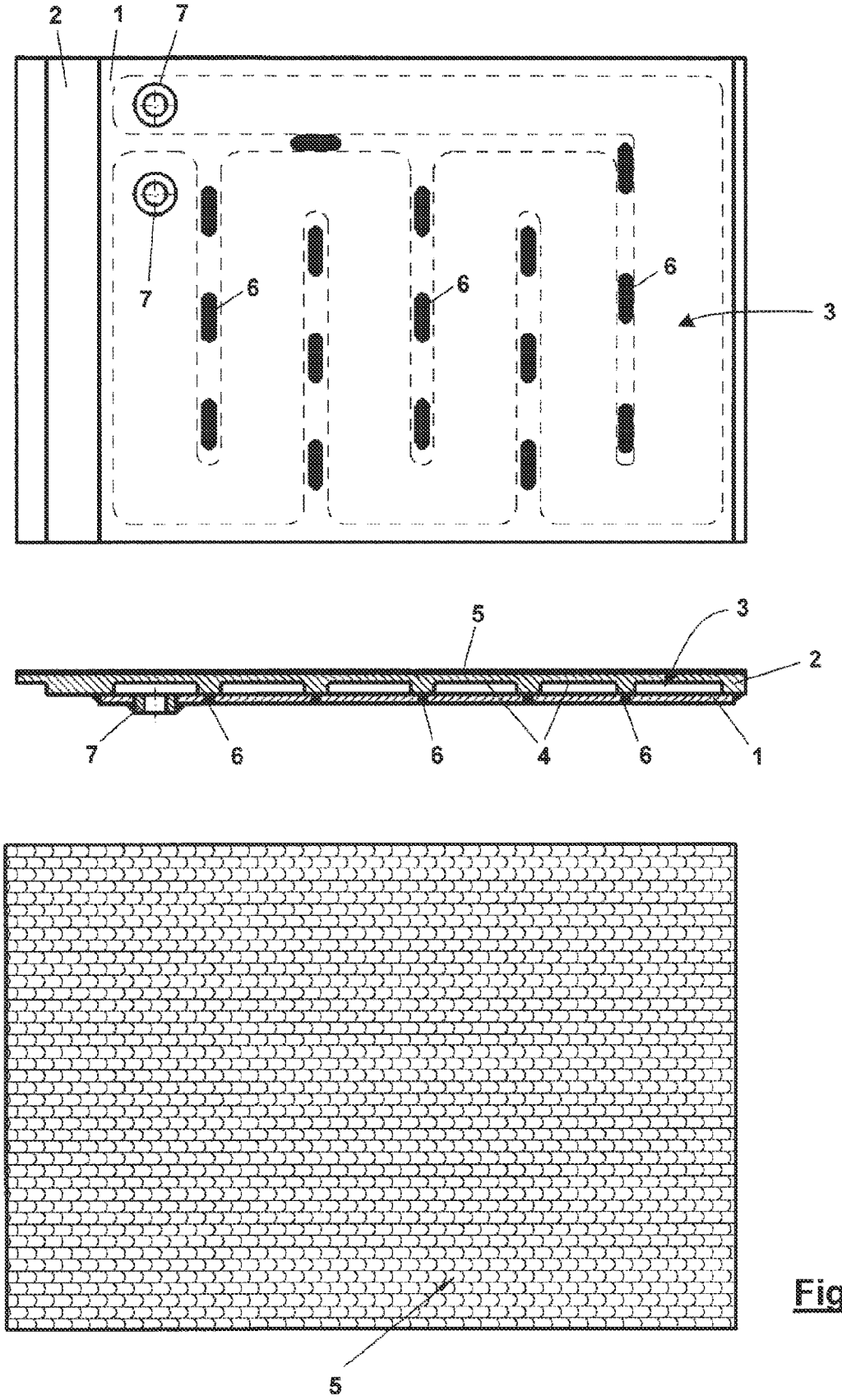
FIG. 1 is a flat cladding element according to the invention viewed from below, in cross section and from above.

FIG. 1 shows a flat cladding element according to the invention for device sections of incinerators viewed from below, in cross section and from above. The cladding element has an upper plate 2 made of steel, and a lower plate 1 made of steel, which lie one atop the other, and have a channel 3 arranged between them for guiding a cooling medium through the cladding element. In the depicted exemplary embodiment, the channel 3 is incorporated into the upper plate 2 as a meandering milled slot 4. The side of the upper plate 2 facing away from the lower plate 1 has a weld plating 5. As mentioned at the outset, the weld plating 5 is a hard applied layer with an especially high abrasion resistance that is applied via robotic welding, for example. Of course, the goal is to achieve other characteristics, such as temperature resistance, high corrosion resistance, etc. This application layer normally has an overall layer thickness of several mm. A multiply structure for the application layer is also often desired and advantageous, since physical properties of the hard applied material can be realized more reliably as a result. The weld plating 5 is depicted in the view from above (see lower portion of FIG. 1) as a flaky pattern for lack of any other suitable mode of representation. At least the edge areas of the lower plate 1 and upper plate 2 are tightly joined together (not shown). This yields the necessary tightness for the cooling medium flowing through the meandering channel 3. Of course, other locations of the lower plate 1 can be joined with the upper plate 2 through other means, such as welding. This is shown on FIG. 1 with additional weld seams 6, which in the exemplary embodiment at hand can of course only be introduced where the lower plate 1 and upper plate 2 contact each other, i.e., in the area of webs between the individual channel sections in this case.

In addition, FIG. 1 shows two threaded sockets 7 welded into the lower plate 1, which can be used to supply and remove the cooling medium. Pipelines, for example for cooling water, can be quickly and easily connected via these threaded sockets.

The simple exemplary embodiment according to FIG. 1 also shows that the meandering channel 3 has a non-constricting cross section between the supply and removal points. The meandering channel 3 also has a number of channel sections that run approximately over the entire length of the cladding element, as well as a number that runs approximately over its entire width. These measures are aimed at achieving as good a distribution of heat as possible within the cladding element.

Figure 2:
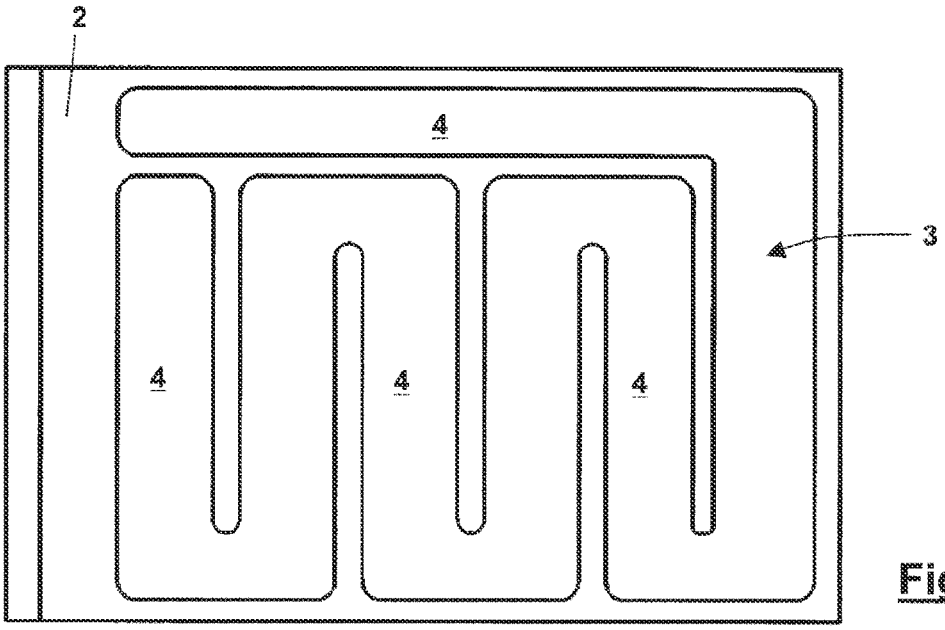
FIG. 2 is an upper plate for a cladding element according to FIG. 1 viewed from below.

FIG. 2 shows the upper plate 2 for a cladding element according to FIG. 1 also viewed from below.

Figure 3:
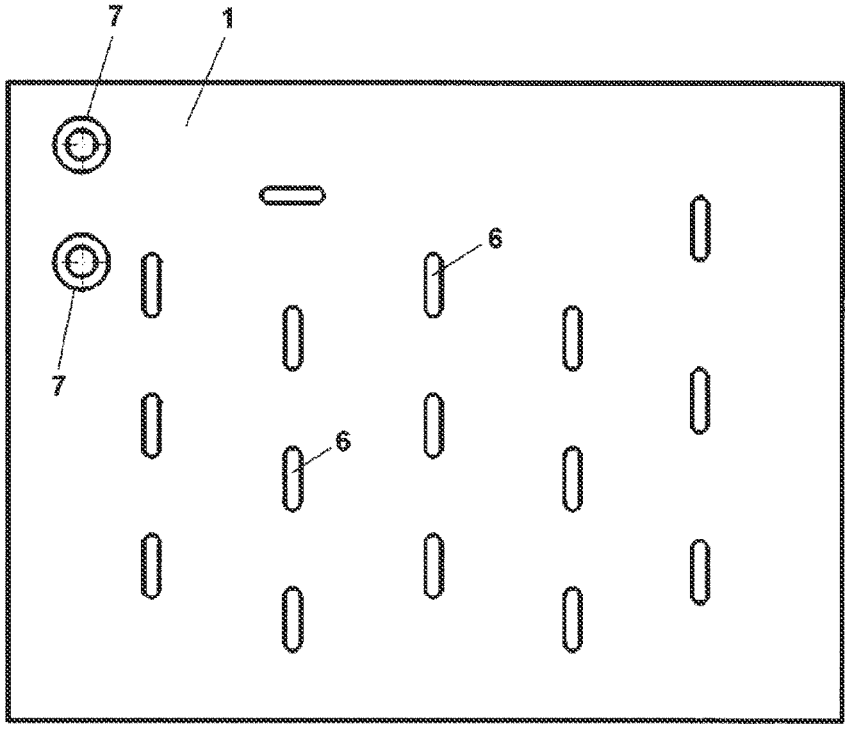
FIG. 3 is a lower plate for a cladding element according to FIG. 1 viewed from below.

FIG. 3 shows the lower plate 1 for a cladding element according to FIG. 1 also viewed from below.

To attach the cladding element to a substructure provided for this purpose or other device sections of the incinerator, the cladding element has connecting means with which it can be easily and quickly be secured to a mount provided for this purpose. These connecting means can be designed in a manner familiar to the expert, for example as bolting, plug-in or suspension means. Since these are known building aids, they are not depicted here.

In addition, the cladding element can also exhibit through holes, through slits or through passages for combustion air to pass through (see FIG. 8). At certain locations, for example on the grate plates in the area of the grate steps of an incinerator, it is most often necessary to supply combustion air from below to facilitate good incineration. However, no such passageways are provided in the present exemplary embodiment according to FIG. 1-3.

Figure 4:
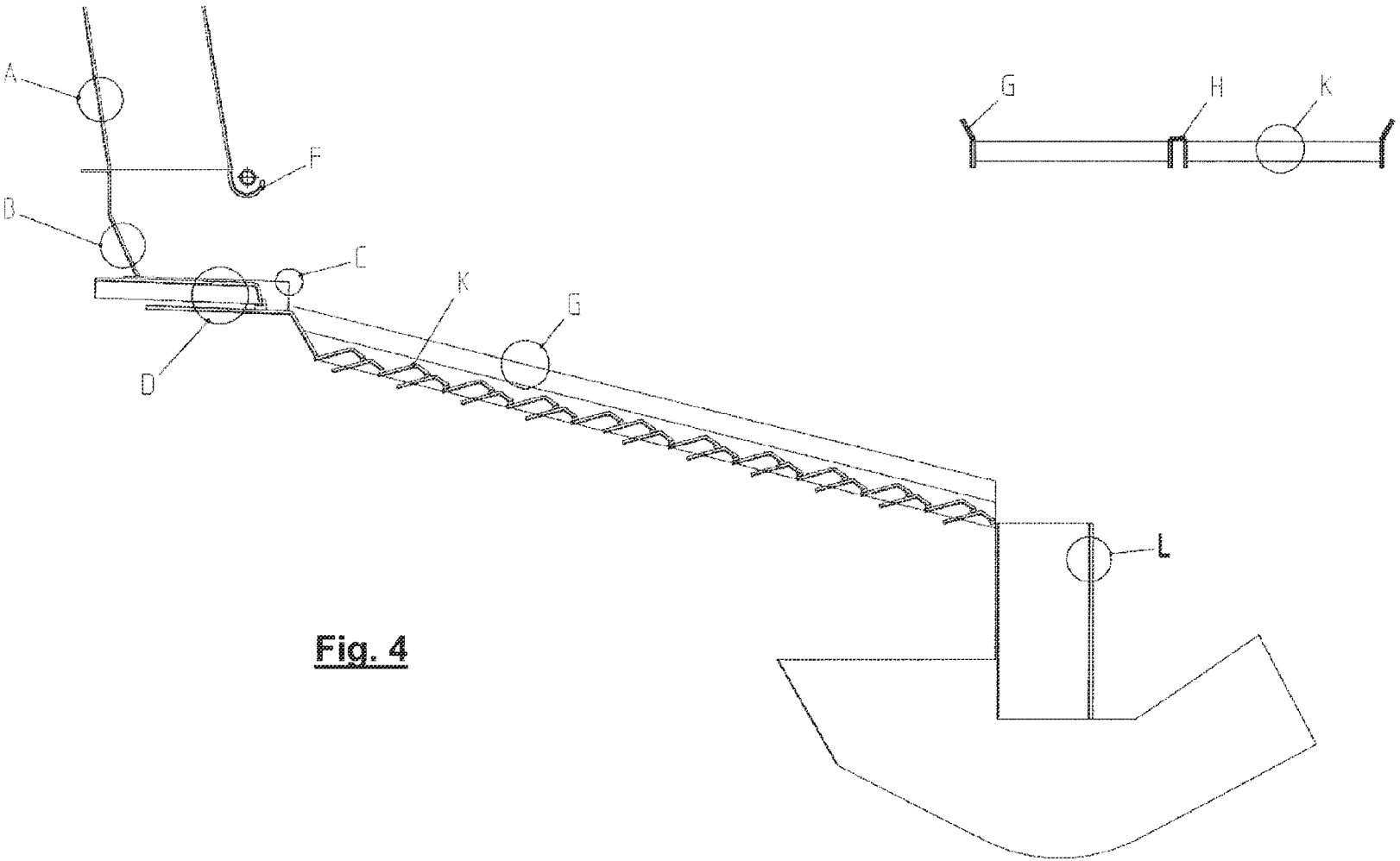
FIG. 4 is a layout for a cladding element according to the invention in embodiments A-L in an incinerator.

Strictly by way of example, FIG. 4 shows a layout for cladding elements according to the invention in embodiments A-L in an incinerator. As already mentioned, cladding elements with the proposed design can basically be used at various locations within an incinerator. They most often differ only in terms of size, shape, quality of weld plating, type of cooling equipment, and more secondary features, such as the type of attachment and integration of combustion air supply lines. For example, it is possible that relatively 'cool' locations, such as the supply shaft, need not have any medium cooling, or that a different quality of weld plating can be selected. FIG. 4 is provided for illustrative purposes in various embodiments A-L:

A is a flat cladding element for lining the garbage shaft,

B is a flat or angled cladding element for the lining in a transitional section, C is an angled cladding element for lining the piston guide, D is a flat cladding element for lining the loading table and piston, F is a rounded cladding element for lining the collector protection means, G is an angled cladding element for lining the lateral grate guide, H is a doubly angled cladding element for lining the middle tunnel in the grate area, K is an angled cladding element for lining the grate steps (similarly to FIG. 1), L is a flat cladding element for lining the slag shaft.

For purposes of further illustration, FIGS. 5, 6 and 7 show cladding elements in embodiments F, D and K. As clearly discernible, the basic structure remains identical, with a lower plate 1 and upper plate 2 in all embodiments.

FIG. 8 shows a cladding element according to the invention in embodiment K for a grate step of a moving grate on a substructure. This exemplary embodiment is intended only to illustrate how the cladding elements can be attached. As diagrammatically shown on FIG. 4, garbage incinerators usually have step-like feed grates, on which the material to be burned is transported into the incineration area, and ash and slag are transported out of the incineration area in a slag shaft. Such a feed shaft consists of grate steps arranged one next to each other. It is usually also the case that at least a number of grate steps can execute lifting motions in the transport direction. In particular in the incineration area, the grate steps are exposed to a high load, making ease of replacement very important here.

The substructure for a grate step is a moving framework 10. An angled cladding element can be bolted to this moving framework 10 via attachment screws 11 in order to line the grate steps. The cooling medium port 12 is bolted to the threaded socket 7. A wearing strip 14 is secured in the area of the front edge. There is a channel-like molding 15 in the rear area of the moving grate, meaning in the area where the individual grate steps overlap. The channel-like molding 15 is used for supporting and positioning the grate step on a round rod of the moving grate structure (not shown). In this embodiment, the front lateral area also has through holes 16 for the supply of combustion air.

As evident from FIG. 8, a defective cladding element can be easily replaced on site for lining the grate steps. To this end, only the attachment screws 11, wearing strip 14 and cooling medium ports 12 have to be detached, after which the cladding element can be removed toward the front.

As mentioned at the outset, there are basically two ways to fabricate the cladding element according to the invention. It can be provided that a cladding element according to the invention first be fabricated as a flat object, and only bent into its final shape afterward. This procedure can only be used for relatively thin cladding elements in light of the bending forces to be applied, as already explained.

For thicker cladding elements, it can be provided that the lower plate 1 and upper plate 2 be fabricated separately as partial objects bent into a reciprocally matching shape, and only joined together thereafter. In this way, cladding elements with a greater wall thickness can be fabricated.

In addition, when separately fabricating the lower and upper plate, it can be provided that, in the case of the plate with the milled slot (either the lower or upper plate), the milled slot initially is continuous in precisely the location where bending then takes place. An example of this fabrication variant is depicted on FIGS. 9 and 10.

Figure 9:
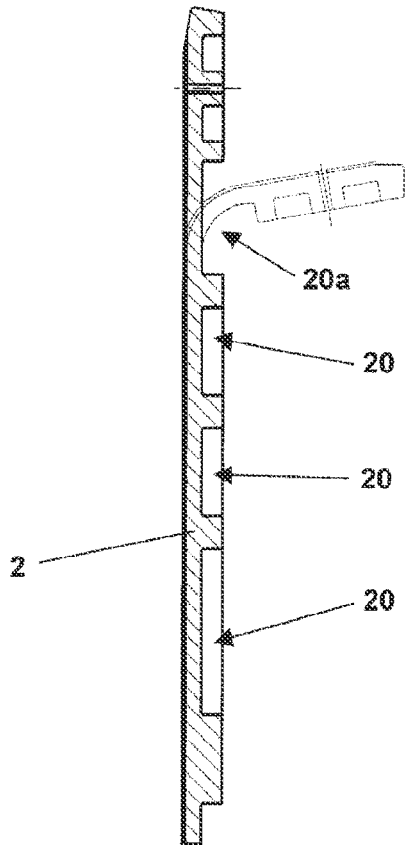
FIG. 9 is an upper plate in cross section, which can be fabricated as a separate partial object.

FIG. 9 here shows an upper plate 2 in cross section, with partial milled slots 20. This upper plate 2 can be fabricated as a separate partial object. The totality of partial milled slots 20 forms the channel 3. Partial milled slot 20*a*, which is also part of the channel 3, runs continuously from one edge to the other, and is situated at the location where bending takes place (denoted with dashed lines). As a consequence, the upper plate 2 can be bent at a location where the lower plate thickness facilitates bending. Prior to assembly with the lower plate, the integrity of the meandering channel at the 'intentionally' milled-out locations must of course be established in such instances by again welding in the corresponding channel wall sections. It requires these enhancements at least in the edge areas of the cladding element, although this of course depends on the envisaged progression of the channel 3.

Figure 10:
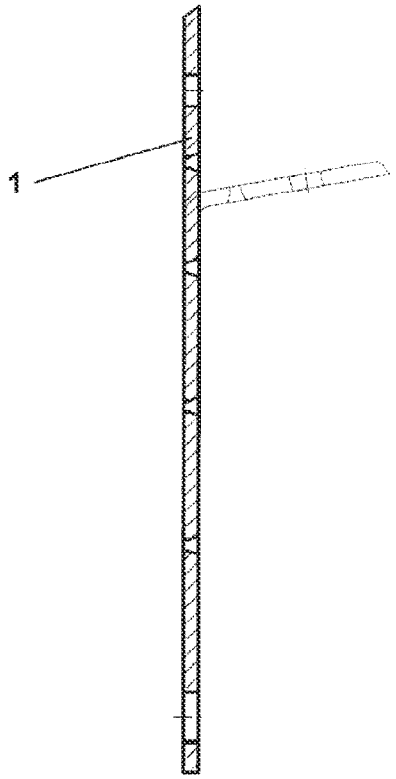
FIG. 10 is a lower plate in cross section, which can be fabricated as a separate partial object, and can be joined with the upper plate according to FIG. 9 to for a cladding element in embodiment K.

Finally, FIG. 10 shows a corresponding lower plate 1 in cross section. This lower plate 1 can be fabricated as a separate partial object. This lower plate 1 fits the upper plate according to FIG. 9, and is also bent at the corresponding location (denoted with dashed lines). After bending is complete, the upper plate according to FIG. 9 and the lower plate according to FIG. 10 can be joined to form a cladding element, or connected to each other by means of welding, for example.

All patents and publications mentioned in this specification are indicative of the levels of those skilled in the art to which the invention pertains. All patents and publications are herein incorporated by reference to the same extent as if each individual publication was specifically and individually indicated to be incorporated by reference. It is to be understood that while a certain form of the invention is illustrated, it is not intended to be limited to the specific form or arrangement herein described and shown. It will be apparent to those skilled in the art that various changes may be made without departing from the scope of the invention and the invention is not to be considered limited to what is shown and described in the specification. One skilled in the art will readily appreciate that the present invention is well adapted to carry out the objectives and obtain the ends and advantages mentioned, as well as those inherent therein. The methods, techniques, and kits described herein are presently representative of the preferred embodiments, are intended to be exemplary and are not intended as limitations on the scope. Changes therein and other uses will occur to those skilled in the art which are encompassed within the spirit of the invention. Although the invention has been described in connection with specific, preferred embodiments, it should be understood that the invention as ultimately claimed should not be unduly limited to such specific embodiments. Indeed various modifications of the described modes for carrying out the invention which are obvious to those skilled in the art are intended to be within the scope of the invention.

REFERENCE LIST

1 Lower plate
2 Upper plate

3 Channel
4 Milled slot
5 Weld plating
6 Weld seam
7 Threaded socket
8-9 Not used
10 Moving framework
11 Attachment screw
12 Cooling medium port
13 Face
14 Wearing strip
15 Channel-like molding
16 Through hole for combustion air
17-19 Not used
20 Partial milled slots
A-L Embodiments of the cladding element

The invention claimed is:

1. A cladding element for device sections of an incinerator, the cladding element comprising:

a lower plate made of steel; and an upper plate made of steel, the upper and lower plates lying one atop the other and bonded with each other at the edge areas of the bonded plates, the bonded upper and lower plates bendable from a substantially flat shape to a non-flat shape, wherein a meandering channel is formed between the upper and lower plates for guiding a cooling medium through the cladding element, the meandering channel fluid tight both before and after bending, wherein the upper or lower plate forms a milled sheet with a meandering milled slot, which forms the meandering channel, and wherein the side of the upper plate facing away from the lower plate has a weld plating.

2. The cladding element according to claim 1, wherein the bonded lower plate and upper plate are bendable into a reciprocally matching shape.

3. The cladding element according to claim 1, wherein the weld plating has a resistance with respect to thermal and/or chemical and/or abrasive loads.

4. The cladding element according to claim 1, wherein the weld plating is a multi-layered structure.

5. The cladding element according to claim 1, wherein the cladding element has connecting means thereby permitting the cladding element to attach to a substructure provided for mounting the cladding element or other device sections of the incinerator.

6. The cladding element according to claim 5, wherein the connecting means are bolting, plug-in or suspension means.

7. The cladding element according to claim 1, wherein the cladding element has through holes, through slits or through passages for combustion air to pass through, or for securing attachment means.

8. The cladding element according to claim 1, wherein the meandering channel has a non-constricting cross section.

9. The cladding element according to claim 1, wherein the meandering channel has a number of channel sections that run approximately over the entire length of the cladding element, as well as a number that runs approximately over its entire width.

* * * * *